United States Patent [19]

Kingsford

[11] Patent Number: 4,687,364

[45] Date of Patent: Aug. 18, 1987

[54] RETRACTABLE MASCARA APPLICATOR

[75] Inventor: Ted I. Kingsford, Memphis, Tenn.

[73] Assignee: Plough, Inc., Memphis, Tenn.

[21] Appl. No.: 755,758

[22] Filed: Jul. 17, 1985

[51] Int. Cl.[4] ..... B41J 1/54

[52] U.S. Cl. ..... 401/127; 401/122; 401/129; 132/88.7

[58] Field of Search ..... 401/122, 118, 119, 124, 401/129, 127, 29; 132/88.7

[56] References Cited

U.S. PATENT DOCUMENTS

| | | | |
|---|---|---|---|
| Re. 21,757 | 4/1941 | Deakers et al. . | |
| 2,294,257 | 8/1942 | Udvarhely et al. . | |
| 2,455,600 | 12/1948 | Molumby et al. | 401/124 X |
| 3,337,901 | 8/1967 | Schefer et al. | 401/129 |
| 3,471,244 | 10/1969 | Melocchi | 401/122 |
| 3,529,899 | 9/1970 | Gruska . | |
| 3,694,096 | 9/1972 | Seidler | 401/127 |
| 3,741,666 | 6/1973 | Vasas et al. | 401/122 X |
| 4,403,624 | 9/1983 | Montgomery | 132/88.7 |

FOREIGN PATENT DOCUMENTS

| | | | |
|---|---|---|---|
| 1463454 | 11/1966 | France | 401/29 |

*Primary Examiner*—Richard J. Apley
*Assistant Examiner*—Robert W. Bahr
*Attorney, Agent, or Firm*—Gerald S. Rosen; Thomas D. Hoffman; Stephen I. Miller

[57] ABSTRACT

A mascara device comprising a container with a mascara reservoir, a retractable mascara brush on a shaft therein and a spring to move the brush longitudinally (axially) between a position inside the reservoir and a position outside the reservoir.

4 Claims, 11 Drawing Figures

FIG. 6a
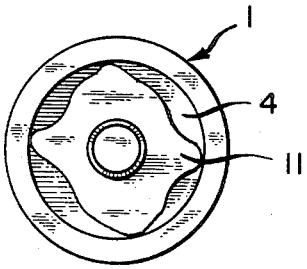
FIG. 6b
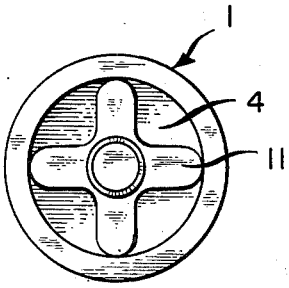
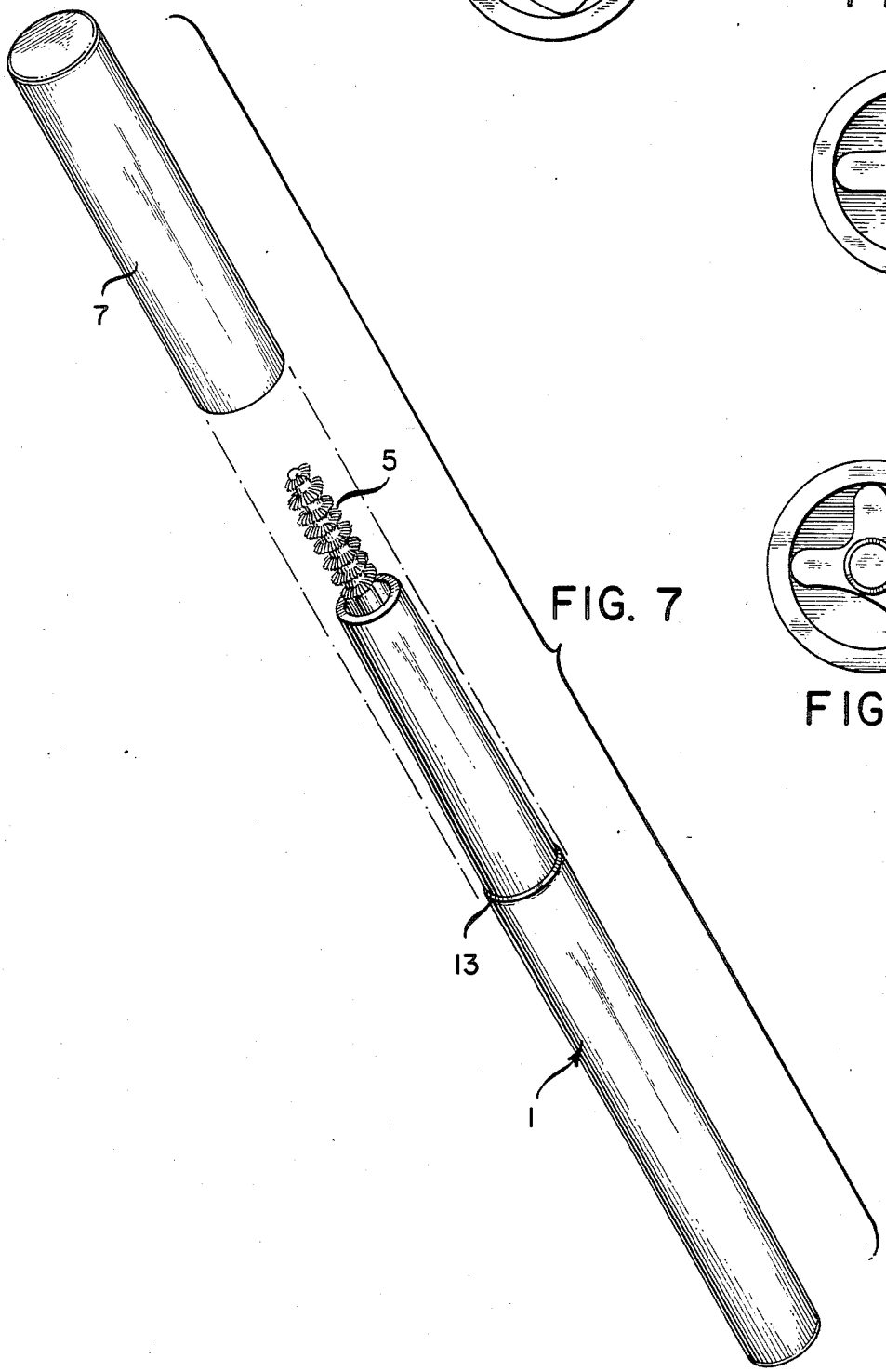
FIG. 7
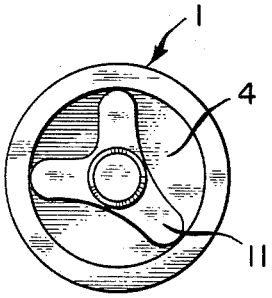
FIG. 6c

RETRACTABLE MASCARA APPLICATOR

BACKGROUND

This invention relates to an improved applicator device for applying mascara. More particularly this invention relates to a mascara applicator device in which the applicator brush is retractable.

During recent years eye makeup has received increased emphasis and numerous applicators have been designed to apply mascaras which curl, color, comb and more evenly distribute the mascara on the lashes. Efforts to increase the portability of and ease of using mascara applicators have given rise to a variety of designs. Most of the prior art applicators include a cap with a protruding applicator which is inserted into a reservoir in a container in order to become loaded with mascara. When removed, the applicator passes through a wiper which removes excess mascara.

Although some known mascara applicator devices are relatively spill-proof, they are inconvenient to use because the applicator brush and reservoir are in separate units.

BRIEF SUMMARY OF THE INVENTION

The mascara applicator device of this invention comprises: an elongated cylindrical container, open at one end, which is a mascara reservoir or has therein a mascara reservoir with an opening; the container also functions as a mascara applicator handle; a mascara brush wiper mounted in the reservoir opening; a mascara brush mounted on a shaft for movement through the wiper between a position inside of the reservoir and a position outside the reservoir; a means for pushing the brush to its position outside the reservoir; a means for preventing the brush from becoming separated from the container and reservoir when it is in its position outside the reservoir; a means to guide the shaft with the brush during its movement; a cap for covering the opening of the container wherein the cap contains means therein to push the brush through the wiper opening into its position in the reservoir and simultaneously close the opening in the wiper. When the cap is removed the brush is released to move through the wiper to its position outside the reservoir.

BRIEF DESCRIPTION OF DRAWINGS

Referring to the accompanying drawings, which are for illustrative purposes:

FIG. 1(*a*) is a side elevational view showing in section a portion of the applicator device of FIG. 1 having a plurality of centering rings;

FIG. 1(*b*) is a side elevational view showing in section a portion of the applicator device of FIG. 1 having a shaft protruding from its bottom end;

FIG. 6(*a*), 6(*b*) and 6(*c*) are top plan views of several embodiments of centering rings suitable for using in this invention; and FIG. 7 is a perspective view of one embodiment of the applicator device with the applicator brush extended, ready for use.

DETAILED DESCRIPTION OF THE INVENTION

Figure 1:
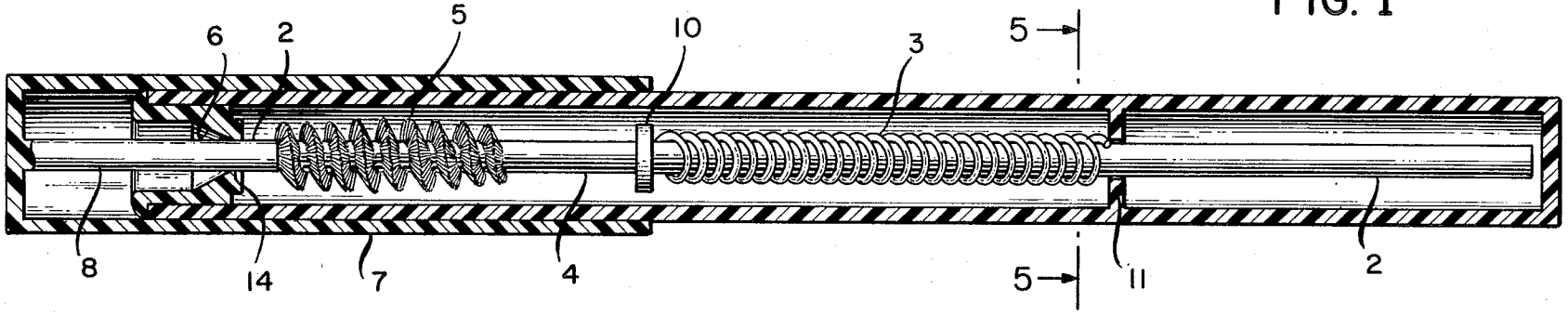
FIG. 1 is a side elevational view showing in section the applicator device of this invention capped with the applicator brush retracted into the reservoir.
Figure 1B:
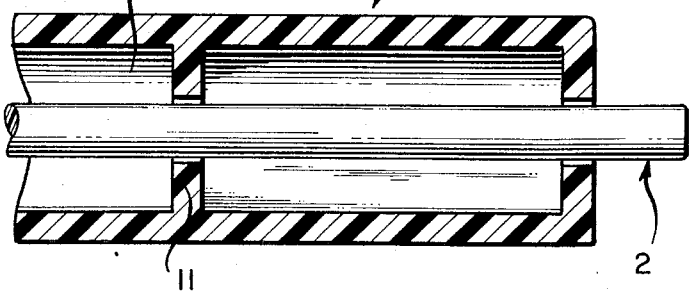
Figure 1A:
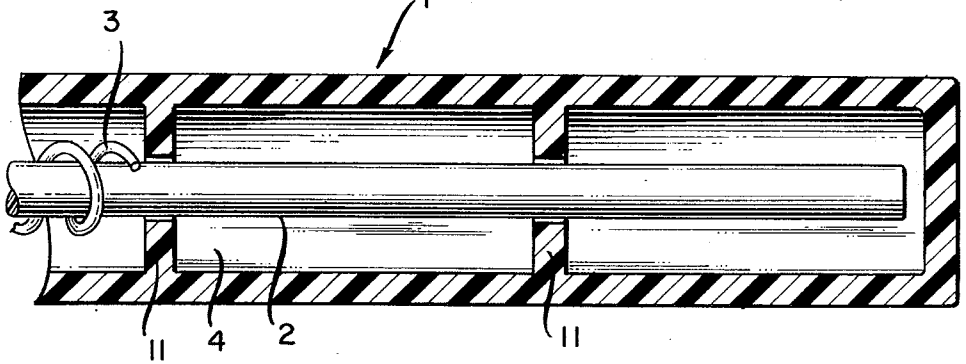
Figure 2:
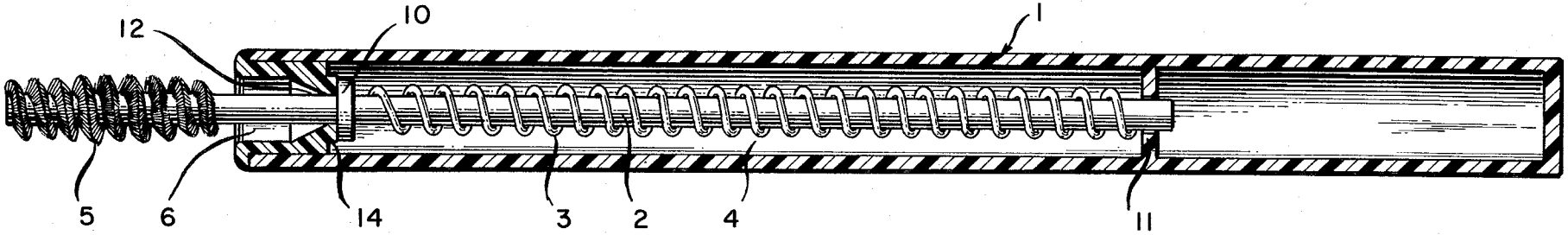
FIG. 2 is a side elevational view showing in section, the cap removed and the applicator brush extended out of the reservoir, ready for use.

Referring again to the drawings, there is illustrated a mascara applicator device that consists of a hollow container 1 of generally tubular configuration with an opening at one end. The container 1 also functions as a handle. The specific configuration of the container-handle 1 can be modified to suit its handle function. For example, it can be generally round with shallow indentations for fingers. The container 1 can be made from molded rigid plastic or thin walled sheet metal. About $\frac{1}{3}$ the length axially (or longitudinally) from the opening of the container 1 is a circumferential bead 13 around the outside circumference of the container 1 which serves to hold a removable cap 7 which closes the container 1 and is shaped to fit over the bead 13. The cap 7 contains therein a centrally located protuberance or pin 8 which serves two functions as described below.

Figure 5:
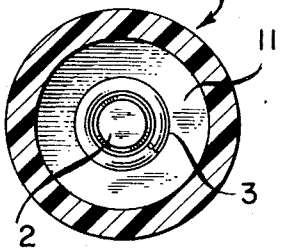
FIG. 5 is a sectional view taken along line 5—5 of FIG. 1 showing a shaft centering ring.

The interior of the container 1 has a movable cylindrical shaft 2 upon which is mounted a mascara applicator brush 5 on the front end. The brush 5 can be made of any conventional configuration used for applying fluent mascara and can be made of bristles, spines and the like. The shaft 2 with the brush 5 is approximately $\frac{3}{4}$ the length of the container 1 and is mounted for movement axially of the brush 5 through a mascara brush wiper 6, located in the opening of the container 1, between a position inside of a mascara reservoir 4 and a position outside said reservoir 4. The complete container 1 below the wiper 6 can function as a mascara reservoir 4 or a centering ring 11 can be placed within the container 1 to form the bottom of a reservoir 4 so that only a portion of the container 1 acts as a reservoir 4. Below the brush 5 on the shaft 2 is a widened area 10 which serves as a shaft guide and stop, preventing the shaft 2 from coming out of the container 1. A means for pushing the brush 5 to its position outside the reservoir 4 when the cap 7 is removed is in container 1. Several means, e.g. a button in a slot in the container 1 wall or an elongation of the shaft 2 to protrude from the bottom of the container 1 as shown in FIG. 1(*b*) are available, a compression spring 3 is preferred. The spring 3 is attached at its top end to the widened area 10 of the shaft 2 from coming out of the container 1. A means for pushing the brush 5 to its position outside the reservoir 4 when the cap 7 is removed is in container 1. Several means, e.g. a button in a slot in the container 1 wall or an elongation of the shaft 2 to protrude from the bottom of the container 1 as shown in FIG. 1(*b*) are available, a compression spring 3 is preferred. The spring 3 is attached at its top end to the widened area 10 of the shaft 2 and at its bottom end to the surface of a centering ring 11. The compression spring 3 is made of spring steel or is a specially molded plastic spring. The shaft 2 and centering ring 11 can be made of molded plastic. The centering ring 11 is held in place in the container 1 by an adhesive, an internal circumferential notch at a position about $\frac{2}{3}$ from the top of the container 1 or it can be an integral molded part of the shaft 2. It can form the bottom of the mascara reservoir 4 depending on its placement and configuration. The configuration of the centering ring 11 should be such that it fits inside the container and be able to be immovably attached to its inside wall or be an integral part of the shaft 2 and moveable therewith. The hole in the center of the centering ring 11 must be of sufficient diameter to accommodate the shaft 2 and enable it to move in a piston-like motion when in the preferred embodiment the centering ring 11 is immovably attached to the inside wall of the container 1. Several embodiments of configuration of centering ring 11 are shown in FIGS. 5, 6*a*, 6*b* and 6*e*. FIG. 5 shows a circular O-ring shape centering ring 11, FIG. 6*a* shows a pillow shaped centering ring 11 attached at its corners to the container 1 wall, FIG. 6*b* shows an X shaped centering ring 11 attached at the ends of its legs to the container 1 wall and FIG. 6*c* shows a Y shaped centering ring 11 attached at the ends of its legs to the container 1 wall. More than one centering ring 11 can be used. The second ring 11, if used, is placed higher up in the container than the lower ring 11 and can act as the bottom of the mascara reservoir 4 if it is O-ring shaped.

A mascara brush wiper 6 is mounted at the opening of the container 1 by a structure e.g. a bead 14 which also acts as a stop to prevent the shaft 2 from separating from the container 1. The wiper 6 can be of any conventional mascara brush wiper design. It is held on the inside wall of the container 1 by the bead 14. The wiper 6 can be made adjustable by means known in the art and it is made of conventionally used thin flexible membranous materials.

The length of the shaft 2 with the brush 5 which is oriented longitudinally within the container 1 is such that when the mascara applicator device is capped and the brush 5 retracted, the top of the brush 5 is inside the mascara reservoir 4 and the bottom of the shaft 2 is below the centering ring 11. If there is more than one centering ring 11, the shaft 2 should extend below the bottom-most ring 11.

Figure 4:
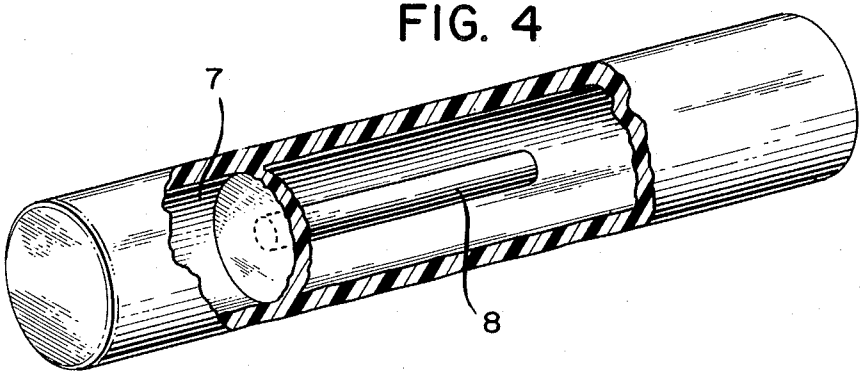
FIG. 4 is a side view of a second embodiment of the cap of the applicator device showing the pin.
Figure 3:
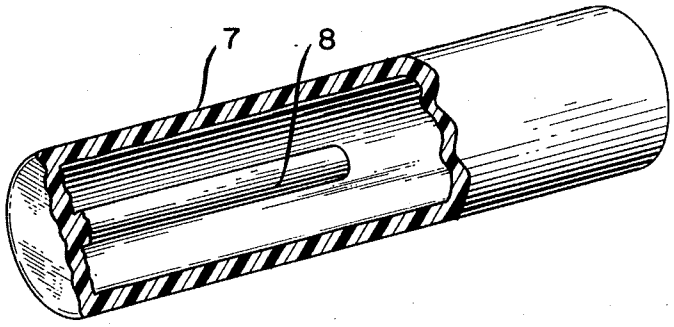
FIG. 3 is a side sectional view of one embodiment of the cap of the applicator device showing the pin.

The cap 7, embodiments of which are shown in FIGS. 3 and 4, contains a pin 8 which, when the cap 7 is inserted over the upper end of the container 1, pushes the brush 5 toward the bottom of the container 1 and through the wiper orifice 12 into the mascara reservoir 4. The pin 8 must be of sufficient length to enter the wiper orifice 12 and seal it against air and leakage. In a preferred embodiment, the cap 7 is held closed by a bead 13 around the outside circumference of the container 1 as shown in FIG. 7. Also, the embodiment of FIG. 7 illustrates one of the possible shapes of the container 1, i.e. tapered at its top portion. The cap 7 preferrably is longer than the pin 8 and, as shown in FIG. 3 in a preferred embodiment, can be attached to the inside center of the top of the cap 7. The embodiment in FIG. 4 illustrates another less preferred design in which the cap 7 has a hollow top and the pin 8 is attached to the center of the lower ceiling in the cap 7.

In operation, as shown in one embodiment, the mascara applicator device of this invention is used as follows:

The user removes the cap 7, releasing the pin's 8 pressure on the brush 5. The spring 3 pushes against the stop 10 on the shaft 2 causing the shaft 2 to move axially upward and the brush 5 to move through the wiper orifice 12 and out of the mascara reservoir 4 of the container 1. The lower end of the shaft 2 is sufficiently long so it will not pass completely through the orifice of the bottom centering ring 11. The applicator device is now ready for use. The user applies mascara by grasping the container 1 in her hand and applying the mascara from the brush 5 in the usual manner. After the mascara is applied the container 1 is capped by placing the cap 7 thereon. The pin 8 in the cap 7 pushes the brush 5 against the force of the spring 3, retracting it axially (longitudinally) into the reservoir 4. If the brush 5 needs reloading with mascara prior to recapping, the user can push it into the reservoir 4 by pressing the brush 5 on a hard surface such as a table then release the brush 5 by removing from the hard surface. Other means can be used, for example, the cap 7 can be placed on the container 1, thus pushing the brush 5 into the reservoir 4, then removed, releasing the brush 5. In addition a button on the container 1 or an elongated shaft 2 can be used to retract the brush 5 into the reservoir 4 to load it with mascara.

I claim:

1. A mascara applicator device and container comprising:

(a) an elongated reservoir for mascara therein having an opening;

(b) a mascara brush wiper with an orifice in the opening;

(c) a brush mounted on a shaft for movement through the wiper between a position inside of the reservoir and a position outside of the reservoir wherein the shaft is oriented longitudinally by at least one centering ring;

(d) a removable cap adapted to simultaneously close the opening and push the brush to its position inside of the reservoir;

(e) a spring means for pushing the brush to its position outside of the reservoir when the cap is removed; and (f) a protrusion from the shaft that is larger than the wiper orifice for preventing the brush from becoming detached from the reservoir when the brush is in its position outside the reservoir.

2. The device of claim 1 wherein there are two centering ring.

3. The device of claim 1 wherein the container has an elongated neck with the opening, the cap is elongated to fit over the neck, and the cap has a longitudinal pin adapted to push the brush into the reservoir.

4. The device of claim 3 wherein the length of the cap's pin is less than the length of the cap.

* * * * *